United States Patent [19]

Wiredal

[11] 4,440,244

[45] Apr. 3, 1984

[54] DRILL TOOL

[75] Inventor: Harry A. I. Wiredal, Sandviken, Sweden

[73] Assignee: Santrade Ltd., Lucerne, Switzerland

[21] Appl. No.: 237,914

[22] Filed: Feb. 25, 1981

[30] Foreign Application Priority Data

Mar. 26, 1980 [SE] Sweden ..... 8002320

[51] Int. Cl.[3] ..... E21B 10/30; E21B 10/56

[52] U.S. Cl. ..... 175/292; 175/389; 175/398; 175/410; 175/415

[58] Field of Search ..... 175/258, 259, 382, 383, 175/384, 171, 398, 399, 400, 410

[56] References Cited

U.S. PATENT DOCUMENTS

| | | | |
|---|---|---|---|
| 3,289,776 | 12/1966 | Cleary | 175/398 |
| 3,753,470 | 8/1973 | Lagerstrom et al. | 175/292 |
| 3,848,683 | 11/1974 | Persson | 175/258 |
| 4,014,395 | 3/1977 | Pearson | 175/410 |
| 4,202,421 | 5/1980 | Pinck | 175/398 X |

FOREIGN PATENT DOCUMENTS

| | | | |
|---|---|---|---|
| 462751 | 1/1969 | Sweden | 175/171 |
| 2031481 | 4/1980 | United Kingdom | 175/398 |

*Primary Examiner*—Ernest R. Purser
*Assistant Examiner*—Joseph Falk
*Attorney, Agent, or Firm*—Burns, Doane, Swecker & Mathis

[57] ABSTRACT

A drill tool for rotary and/or percussion drilling with drill rod means (14) within casing tube means (15) comprises a centric cutting bit (11) and an eccentric reamer cutter (12), both provided with hard metal inserts. For purposes of obtaining a life of the drill tool as long as possible the first frontal insert (23) on the reamer cutter (12) is positioned in front of the first peripheral insert (18) when seen in the rotational direction (D) during drilling, and the centric cutting bit (11) provided with more inserts on the half (38) of its front surface opposed to the reamer cutter (12) during drilling than on the other half (39).

11 Claims, 6 Drawing Figures

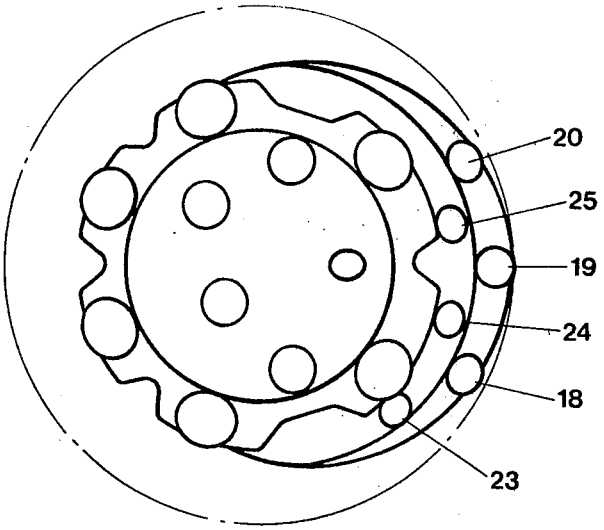
Fig. 3
Fig.5
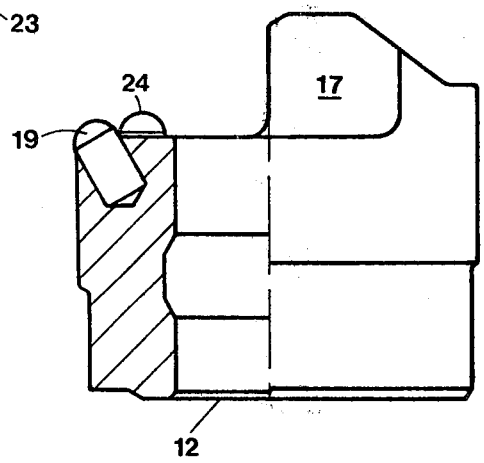
Fig.4
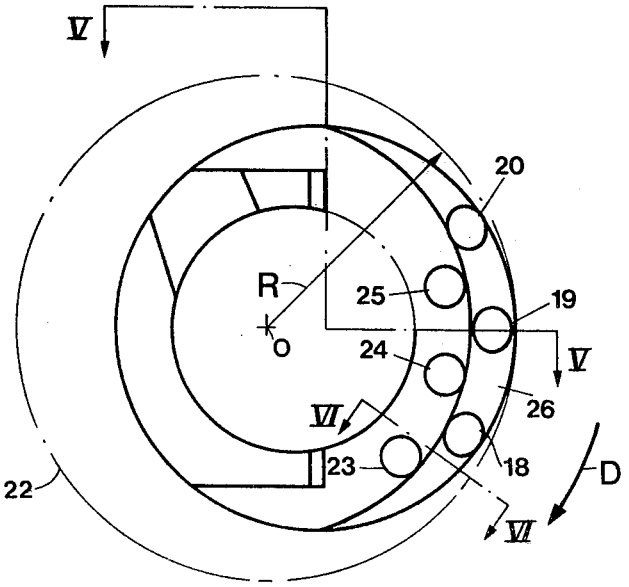
Fig.6
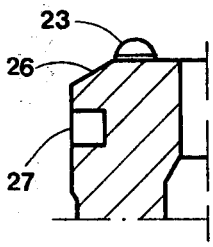

DRILL TOOL

The present invention relates to the earth-rock drilling art, and more precisely to a drill tool for rotary and/or percussion drilling with drill rod means within casing tube means. The drill tool comprises a centric cutting bit provided with cutting means and an eccentric reamer cutter provided with cutting means and positioned rearwardly of the centric cutting bit. The drill tool is designed for connection to the front end of the drill rod means. The reamer cutter is shiftable relative to the cutting bit between a drilling position, in which it protrudes laterally beyond the casing tube means, and a retracted position, in which it is retracted radially within the casing tube means as viewed in the longitudinal direction.

Drill tools of this type are disclosed in U.S. Pat. Nos. 3,753,470 and 3,848,683 and Swedish Pat. No. 411 139. In these prior art drill tools the centric cutting bit is provided with four radially extending hard metal cutting inserts while the reamer cutter is provided with one or two radially extending hard metal cutting inserts.

In the present invention the cutting inserts are replaced by button inserts. The object of the invention is then to provide the centric cutting bit and the reamer cutter with such insert patterns that a life as long as possible is obtained for the drill tool. This and other objects are attained by giving the invention the characterizing features stated in the appending claims.

The invention is described in detail in the following with reference to the accompanying drawings in which one embodiment is shown by way of example. It is to be understood that this embodiment is only illustrative of the invention and that various modifications may be made within the scope of the claims.

In the drawings, FIG. 1 shows a drill tool according to the invention in drilling position.

FIG. 3 shows an end view of both the centric cutting bit and the reamer cutter seen in the direction II—II in FIG. 1.

FIG. 4 shows an end view of solely the reamer cutter seen in the direction II—II in FIG. 1.

FIG. 5 shows a section taken on the line V—V in FIG. 4.

FIG. 6 shows a section taken on the line VI—VI in FIG. 4.

Figure 1:
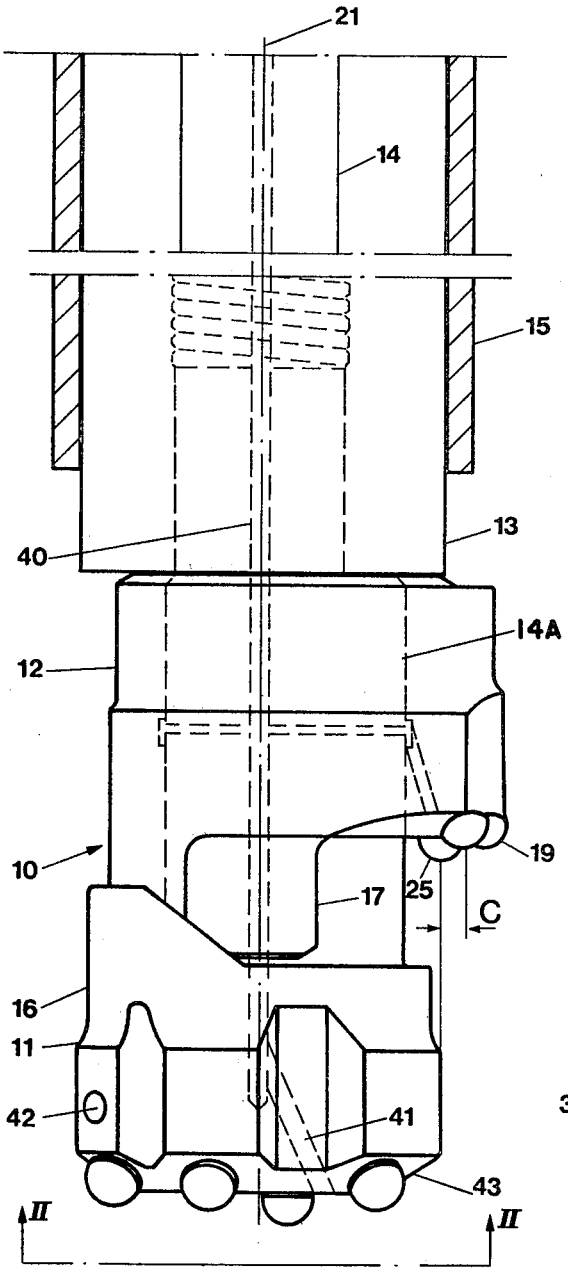
Figure 2:
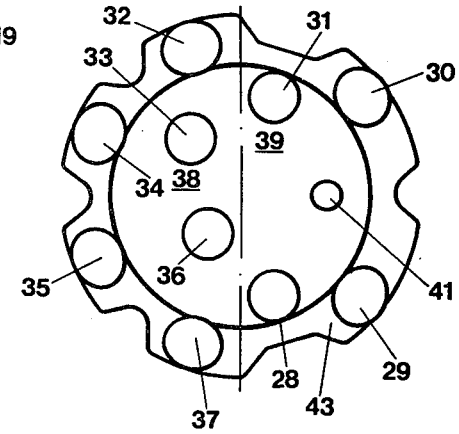
FIG. 2 shows an end view of solely the centric cutting bit seen in the direction II—II in FIG. 1.

The drill tool generally denoted by 10 in FIG. 1 comprises a centric cutting bit 11, an eccentric reamer cutter 12 rearwardly thereof and a guide body 13. The drill tool 10 is connected to the front end of a string 14 of extension drill rods, which traverses through a string 15 of casing tubes. The drill tool is guided relative to the casing tube string 15 by means of the guide body 13. For allowing drilling debris to be removed through the annular space between the strings 14, 15 the guide body 13 can be provided with a groove in its envelope surface as shown in Swedish Pat. No. 411 139. Alternatively, an annular slot may be provided between the guide body 13 and the casing tube string 15 in which case guiding of the drill tool and removal of drilling debris are carried out as shown in U.S. Pat. No. 3,848,683.

The reamer cutter 12 is rotated by the centric cutting bit 11 by means of cooperating projections 16, 17 on the cutting bit and the reamer cutter, respectively, between a drilling position, in which it protrudes laterally beyond the casing tube string 15, see FIG. 1, and a retracted position, in which it is retracted radially within the string 15 as viewed in the longitudinal direction. That is, the reamer cutter 12 is rotatably disposed upon a cylindrical portion 14A of the drill string 14 whose center axis is displaced relative to the axis of rotation of the drill string (i.e., is eccentric). Thus, when the drill string 14 rotates relative to the reamer cutter 12, the radial position of cutters 18, 19, 20, 23, 24, 25 of the reamer cutter 12 changes relative to the tubing 15. When the drill rotates during drilling, the reamer cutter 12 is retained by the surrounding earth material so that the drill rotates within the reamer cutter 12, thereby radially displacing the latter to the drilling position depicted in FIG. 1. Upon engagement of the projections 16, 17, the projection 16 drives the reamer cutter 12 for rotation along with the bit 11. When the tool is being extracted, the drill string 14 is rotated in the opposite direction to radially displace the reamer cutter 12 inwardly to a position in which the drill string can be raised through the tubing 15.

According to the invention the reamer cutter is provided with the button inserts 18, 19, 20 of hard material, such as cemented carbide. These inserts are inclined relative to the longitudinal centre axis 21 of the drill tool 10 and located at the same radial distance R from the centre axis 21 and thus also from the centre 0 of the drill hole 22, which means that the diameter of the drill hole is determined by these peripheral inserts. Due to this fact a cooperation between the inserts 18, 19, 20 is created so that (a) a large wear resistance is obtained, and (b) remaining inserts continue drilling to the whole hole diameter in case one insert breaks or becomes loose. The insert 18 constitutes the leading cutter of this group of inserts 18, 19, 20 since it is disposed ahead of the other cutters 19, 20 in the rotational direction.

According to the invention the reamer cutter 12 is further provided with button inserts 23, 24, 25 of hard material, such as cemented carbide. The inserts 23, 24, 25 are positioned radially inwardly of the inserts 18, 19, 20. The frontal inserts 23, 24, 25 are designed for crushing the annular core C which is formed between the pilot hole drilled by the centric cutting bit 11 and the inserts 18, 19, 20. The leading one, 23, of the inserts 23, 24, 25 is thus positioned ahead of the first one, 18, of the inserts 18, 19, 20 seen in the rotational direction D of the drill tool during drilling. Due to this location the insert 23 will protect that surface of the reamer cutter 12 which is in front of the insert 18 and thus decreasing the risk for this insert to get loose or be broken. The frontal inserts 23, 24, 25 are preferably directed axially but may alternatively be somewhat outwardly inclined relative to the centre axis 21 toward the periphery.

The frontal inserts 23, 24, 25 and the peripheral inserts 18, 19, 20 are alternately arranged along the periphery of the reamer cutter 12. The peripheral inserts are inclined relative to the centre axis 21 and form an angle therewith which is between 20° and 40°, with preference for values between 25° and 35°. The peripheral inserts 18, 19, 20 are arranged on a bevelled portion 26 of the reamer cutter 12. The portion 26 is configured such that its radial extension is largest at or between the inserts 18, 19, 20 and decreases circumferentially in both directions.

According to the invention a wear protection means in the form of a button insert 27 of hard material, such as cemented carbide, is arranged in the envelope surface of the reamer cutter 12, i.e. the surface which is exposed to the wall of the bore hole. The insert 27 is arranged in front of the insert 18 seen in the rotational direction D and axially therebehind. The insert 27 is further arranged circumferentially between the inserts 18, 23. In similarity with the insert 23 also the insert 27 will protect the portion of the reamer cutter 12 which is in front of the insert 18 and thus decreasing the risk that this insert falls out or breaks.

According to the invention the centric cutting bit 11 is also provided with cylindrical inserts of hard material, such as cemented carbide. During drilling laterally directed forces arise, which are taken up by the cutting bit 11 and the casing tube string 15 which are surrounded by overburden or soil. These lateral forces cause an uneven wear of the peripheral inserts 29, 30, 32, 34, 35, 37 of the centric cutting bit. For purposes of counteracting or delaying this wear there is according to the invention provided a larger number of inserts 32–37 on that half 38 of the front surface of the cutting bit 11 being opposed to the reamer cutter 12 during drilling than on the other half 39.

Flushing fluid is supplied through a central flushing channel 40 which through a branch passage 41 terminates on the half 39 of the front surface provided with fewer inserts.

In order to decrease the wear of the envelope surface of the centric cutting bit 11 at least one wear protection means 42 in form of an insert of hard material, such as cemented carbide, is mounted in the side of the envelope surface which is opposed to the reamer cutter 12 during drilling.

The peripheral inserts 29, 30, 32, 34, 35, 37 of the centric cutting bit 11 are mounted on a circumferential bevel 43 at the same radial distance, while the frontal inserts 28, 31, 33, 36 are located radially inwardly of the peripheral inserts. The frontal inserts 33, 36 on that half 38 of the front surface being opposed to the reamer cutter 12 during drilling are positioned closer to the centre of the cutting bit 11 than the frontal inserts 28, 31 on the other half 39 of the front surface.

I claim:

1. A drill tool for rotary and/or percussion drilling with drill rod means disposed within casing tube means comprising a centric cutting bit provided with cutting means in form of button inserts of hard material, such as cemented carbide, and an eccentric reamer cutter provided with cutting means and positioned rearwardly of said cutting bit, the drill tool being adapted to be connected to said drill rod means, said reamer cutter being movable relative to the cutting bit between a drilling position, in which it protrudes laterally beyond the casing tube means, and a retracted position, in which it is retracted radially within said casing tube means, characterized in that the number of button inserts on that half of the front portion of the cutting bit being opposed to the reamer cutter during drilling is larger than the number of button inserts on the other half of the front portion of the cutting bit.

2. A drill tool according to claim 1, wherein the cutting bit is provided with a flushing channel which terminates on the half of the front portion of the cutting bit provided with the smaller number of button inserts.

3. A drill tool according to claim 1, wherein at least one wear protection means in form of a button insert of hard material, such as cemented carbide, is arranged on the side of the envelope surface of the cutting bit being opposed to the reamer cutter during drilling.

4. A drill tool according to claim 1, wherein the cutting bit is provided with a bevelled portion extending circumferentially therearound, comprising peripheral button inserts on said bevelled portion on both halves of the front portion of the cutting bit and at the same radial distance, and front button inserts arranged radially inwardly of said peripheral button inserts, the front button inserts on the half of the front portion of the cutting bit opposed to the reamer cutter during drilling being closer to the center of the cutting bit than the front button inserts on the other half of the front portion of the cutting bit.

5. A drill tool for rotary and/or percussion drilling, said drill tool being mountable upon a drill rod for travel within a tubular casing, said drill tool comprising:

a centric cutting bit provided with inner cutting means, and an eccentric reamer cutter provided with outer cutting means, said reamer cutter positioned longitudinally rearwardly of said cutting bit and being shiftable relative thereto between a drilling position in which said reamer cutter protrudes laterally beyond the tubular casing, and a retracted position in which said reamer cutter is retracted radially within the tubular casing as viewed longitudinally, said outer cutting means comprising first and second portions, said first portion including a first button insert defining the leading cutter of said first portion, said first insert being inclined relative to the longitudinal axis of the drill tool and peripherally arranged to define the diameter of the hole to be drilled, said second portion including a second button insert defining the leading cutter of said second portion, said second insert positioned radially inwardly of said first button insert so as to work an annular core which is formed between a pilot hole drilled by the cutting bit and said first insert, said second insert positioned ahead of said first button insert in the rotational direction of the drill tool.

6. A drill tool according to claim 5, wherein there are provided at least two of each of said first and second button inserts, the first and second button inserts being alternately circumferentially arranged.

7. A drill tool according to claim 6, wherein the first button inserts are arranged on a bevelled portion of the reamer cutter, the radial extension of said bevelled portion being largest at or between said first button inserts and decreasing circumferentially in both directions.

8. A drill tool according to claim 5, wherein the first button insert is inclined relative to the longitudinal axis of the drill tool at an angle between 20° and 40°.

9. A drill tool according to claim 8, wherein said angle lies between 25° and 35°.

10. A drill tool according to claim 5, wherein a wear protection means in form of a button insert of hard material, such as cemented carbide, is arranged on the envelope surface of the reamer cutter in front of the first button insert when seen in the rotational direction of the drill tool during drilling and axially behind said first button insert.

11. A drill tool according to claim 10, wherein the wear protection means is arranged circumferentially between the first and second button insert.

* * * * *